US008359120B2

(12) United States Patent
Drenth

(10) Patent No.: US 8,359,120 B2
(45) Date of Patent: Jan. 22, 2013

(54) METHOD AND APPARATUS FOR PREPARING MAIL PIECES

(75) Inventor: Klaas Drenth, Drachten (NL)

(73) Assignee: Neopost Technologies, Bagneux (FR)

( * ) Notice: Subject to any disclaimer, the term of this patent is extended or adjusted under 35 U.S.C. 154(b) by 548 days.

(21) Appl. No.: 12/696,662

(22) Filed: Jan. 29, 2010

(65) Prior Publication Data

US 2010/0222916 A1 Sep. 2, 2010

(30) Foreign Application Priority Data

Jan. 30, 2009 (EP) ..... 09151825

(51) Int. Cl.
*G06F 7/00* (2006.01)

(52) U.S. Cl. ..... 700/222; 700/220; 700/227; 270/52.06; 270/58.06

(58) Field of Classification Search ..... 700/219, 700/220, 221, 222; 270/1.01, 17, 52.06, 270/58.06

See application file for complete search history.

(56) References Cited

U.S. PATENT DOCUMENTS

| | | | | |
|---|---|---|---|---|
| 3,652,078 | A | 3/1972 | Sather et al. | |
| 4,527,791 | A * | 7/1985 | Piotroski | 270/52.09 |
| 4,549,278 | A * | 10/1985 | Minamida et al. | 700/305 |
| 4,817,042 | A * | 3/1989 | Pintsov | 700/220 |
| 4,959,795 | A * | 9/1990 | Christensen et al. | 705/407 |
| 5,367,450 | A * | 11/1994 | Pintsov | 705/7.37 |
| 5,547,178 | A * | 8/1996 | Costello | 270/52.02 |
| 5,659,481 | A * | 8/1997 | Qutub et al. | 700/219 |
| 5,734,566 | A * | 3/1998 | Stengl | 700/9 |
| 6,249,716 | B1 * | 6/2001 | Edens et al. | 700/222 |
| 6,334,119 | B1 * | 12/2001 | Gagliardi et al. | 705/60 |
| 6,450,494 | B1 | 9/2002 | Adema | |
| 6,496,810 | B1 | 12/2002 | Pollard et al. | |
| 6,826,445 | B2 * | 11/2004 | DiNapoli et al. | 700/223 |
| 8,040,539 | B2 * | 10/2011 | Zamanian et al. | 358/1.13 |
| 2005/0071291 | A1 | 3/2005 | Mayer et al. | |
| 2006/0027958 | A1 * | 2/2006 | Lapstun et al. | 270/1.01 |

FOREIGN PATENT DOCUMENTS

| | | |
|---|---|---|
| EP | 1016612 A1 | 7/2000 |
| NL | 1010934 C2 | 7/2000 |

* cited by examiner

*Primary Examiner* — Patrick Mackey
(74) *Attorney, Agent, or Firm* — Sughrue Mion, PLLC

(57) ABSTRACT

A method and apparatus is disclosed for preparing mail pieces. By determining the number of postal items of a mail set that is fed or to be fed to a gathering station, the further processing can be based thereon, and if the number of postal items exceeds a predetermined maximum, the mail set is split by transporting the already gathered postal items from the gathering station to the inserting station, where the postal items are inserted in an envelope and an envelope printer can print an association marking on the envelope of the formed mail piece.

12 Claims, 3 Drawing Sheets

METHOD AND APPARATUS FOR PREPARING MAIL PIECES

FIELD AND BACKGROUND OF THE INVENTION

The invention relates to a method and an apparatus for preparing mail pieces.

In the field of mail processing it is known to gather several postal items, such as a letter with enclosures and/or an account statement consisting of several pages, of a mail set to be sent to the same recipient and insert the gathered postal items in the same envelope. However, the maximum number of postal items that can be combined into a mail piece is limited. For example, the maximum number of postal items that can be folded simultaneously in a folding station can be limited. Furthermore, limitations can be imposed by a maximum thickness of the gathered stack of postal items that can be inserted reliably into a single envelope. Furthermore an upper weight limit of a postage category can make it unattractive to add postal items causing the weight limit to be exceeded, in particular if a postage meter is used that can only apply a single postage value to all mail pieces to be franked during a job. Only when such limitations are anticipated as the postal items are defined or prepared, it is possible to take measures in advance to distribute the postal items of a mail set over a plurality of mail pieces.

However, in practice it is a cumbersome burden for staff determining the contents of documents to be sent to recipients to take into account limitations of physically preparing and mailing the mail sets, in particular because the physical preparation of the mail pieces is a highly automated process typically carried out remote from the persons determining the contents of documents to be sent. When limitations imposed by the preparation of mail pieces are not anticipated, or when printing additional information on the postal items is not possible or not desired, as e.g. with glossy brochures, special measures are required to avoid limitations as discussed. It is for instance known to feed envelopes of different sizes in which documents are to be inserted in accordance with the number of postal items to be inserted. Providing a larger envelope may also eliminate the need for folding, and a larger number of postal items can be inserted in a larger envelope.

However, such measures require relatively complex and accordingly costly machinery for preparing the postal items. Such apparatus can be employed economically only if the additional features are used frequently.

SUMMARY OF THE INVENTION

It is an object of the present invention to allow the preparation of mail sets consisting of widely varying numbers of postal items with relatively simple mail preparation items and without causing substantive inconvenience for the recipient or excessive additional costs.

According to the invention, this object is achieved by providing a method for preparing mail pieces including: providing an apparatus for preparing items to be mailed, the apparatus including: at least one feeding station for feeding postal items of a mail set one by one; a gathering station, a printer for printing on postal items fed from the feeding station or on envelopes, an inserting station for inserting postal items into envelopes. The method further includes, for each mail set: feeding one or more postal items from the at least one feeding station, if more than one postal item is fed to the gathering station, gathering the postal items in the gathering station, if all postal items of the mail set have been gathered or if a predetermined maximum of postal items has been gathered, transporting the gathered postal items to the inserting station; at the inserting station, inserting the gathered postal items into an envelope; determining whether the mail set includes or is to include more postal items than the predetermined maximum of postal items of a mail piece; and if the mail set includes or is to include more postal items than the predetermined maximum of postal items of a mail piece, inserting at least one remaining postal item of the mail set into a next envelope of a next mail piece, and printing an association marking on at least a postal item or the envelope of the mail piece or on a postal item or the envelope of the next mail piece. The association marking indicates that the mail piece or next mail piece carrying the association marking is associated to the next mail piece or, respectively, the mail piece.

The invention can also be embodied in an apparatus for preparing items to be mailed, including: at least one feeding station for feeding postal items of a mail set one by one, a gathering station, a control logic, a sensor placed downstream of the at least one feeding station and upstream of the gathering station for detecting postal items of a mail set, a printer for printing on postal items fed from the feeding station or on envelopes, and an inserting station for inserting postal items into envelopes. The sensor is connected to the control logic and arranged for scanning markings from documents in the feeding path and generating signals in accordance with the scanned markings. The control logic is arranged for: generating a gather signal if a mail set comprises more than one postal item, generating a transport signal if a mail set is completely fed to the gathering station or if a predetermined maximum of postal items is fed to the gathering station, and generating a mark signal if a mail set is to include more postal items than a predetermined maximum. The gathering station is arranged for: gathering postal items arriving from the at least one feeding station in response to the gather signal, and transporting the gathered postal items towards the inserting station in response to the transport signal. The control logic is arranged for, in response to the mark signal, causing the printer to print an association marking on at least a postal item or an envelope of a mail piece or on a postal item or an envelope of a next mail piece. The association marking indicates that the mail piece or next mail piece carrying the association marking is associated to the next mail piece or, respectively, the mail piece.

By determining whether the mail set includes or is to include more postal items than the predetermined maximum of postal items of a mail piece; and, if the mail set includes or is to include more postal items than the predetermined maximum of postal items of a mail piece, inserting at least one remaining postal item of the mail set into a next envelope of a next mail piece, and printing an association marking on a postal item or the envelope of the mail piece or on a postal item or the envelope of the next mail piece, the association marking indicating that the mail piece carrying the association marking is associated to the other one of mail piece and the next mail piece, large mail sets are automatically distributed over a plurality of mail pieces and the recipient can easily infer from the marking on the mail piece that the mail pieces over which the postal items of a mail set have been distributed are associated and contain associated postal items.

Particular elaborations and embodiments of the invention are set forth in the dependent claims.

Further features, effects and details of the invention appear from the detailed description and the drawings.

DETAILED DESCRIPTION

Figure 1:
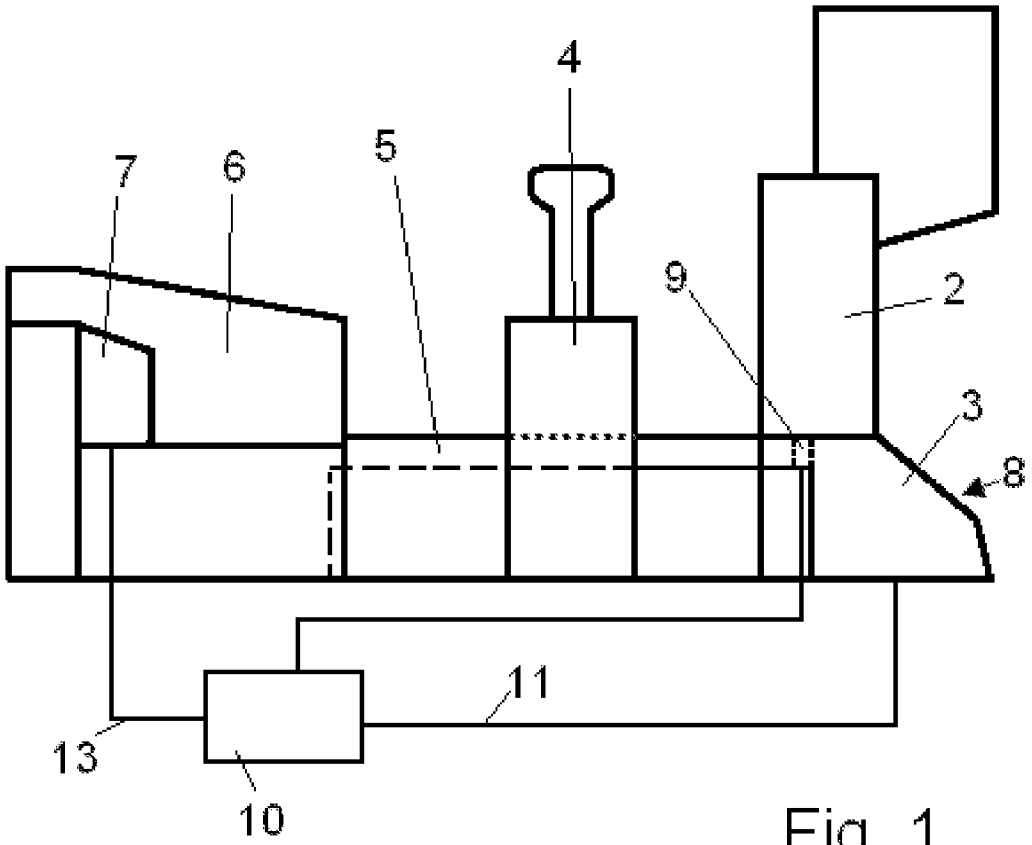
FIG. 1 is a schematic side-view of an example of a system for processing postal items.

In FIG. 1, an example of a system for processing postal items is shown. The system has successive processing stations 2-4, 6, 7. The processing stations 2-4, 6, 7 are arranged in a general processing order 8 of the postal items. In processing order, the stations of the system 1 according to the present example are a feeding station 2 for feeding separate sheets, a gathering station 3, a folding station 4, an inserting station 6 and an envelope printer 7 for printing on envelopes into which postal items have been inserted in the inserting station 6. A transport unit 5 is provided for transporting postal items from the gathering station 3 to the folding station 4 and from the folding station 4 to the inserting station 6. The system further comprises a scanner 9 downstream of the feeding station 2 and upstream of the gathering station 3 for detecting postal items. A control logic 10 in the form of a programmable circuitry is connected to the stations for controlling operation of the system.

In operation, postal items are fed one by one by the feeding station 2, detected by the scanner 9 when passing by and gathered at the gathering station 3 to form a stack. Instead of a single feeding station, multiple feeding stations and/or a printer may be provided and arranged along a feeding path such that postal items of a mail set can be fed from the feeding stations to the gathering station and gathered into a stack at the gathering station 3. The scanner 9 scans markings on passing postal items and generates scanning signals in accordance with the scanned markings. The control logic 10 is connected to the scanner 9, processes the signal from the scanner 9 and determines the number of postal items fed to the gathering station 3, as well as the total number of postal items of a mail set to be prepared. Which postal items belong to the same mail set to be sent to a single addressee may be identified by markings on the first postal item of each mail set or on the last postal item of each mail set, but also by a change of the address or other marking on the postal items if a next document belonging to a next mail set is scanned. The total number of postal items of a mail set may be determined by counting or be read from a first postal item if indicia indicating the number of postal items are provided on the first postal item of each mail set.

The control logic 10 is further arranged for generating and outputting a gather signal via line 11 if a mail set comprises more than one postal item, for generating and outputting a transport signal via line 11 if a mail set is completely fed to the gathering station 3 or if a predetermined maximum number of postal items is fed to the gathering station 3, and generating and outputting a mark signal via a line 13 to the envelope printer 7 if a mail set includes more postal items than a predetermined maximum.

In the gathering station 3, postal items from one mail set are gathered in response to the gather signal 11. In response to the transport signal the gathered stack of postal item is transported to the folding station 4 along the transport unit 5. In the folding station 4 the postal items are folded. Next, the folded stack of postal items is transported to the inserting station 6 along the transport unit 5. At the inserting station 6 the postal items are inserted in an envelope, thus forming a mail piece. The envelopes can have a window through which an address printed on an outer face of the folded stack of postal items is visible. By printing an address on the envelope at the envelope printer 7, use of non-window envelopes on the outside of which the delivery address is printed is also made possible. In response to the mark signal, the envelope printer 7 prints an association marking on the envelope.

Figure 2:
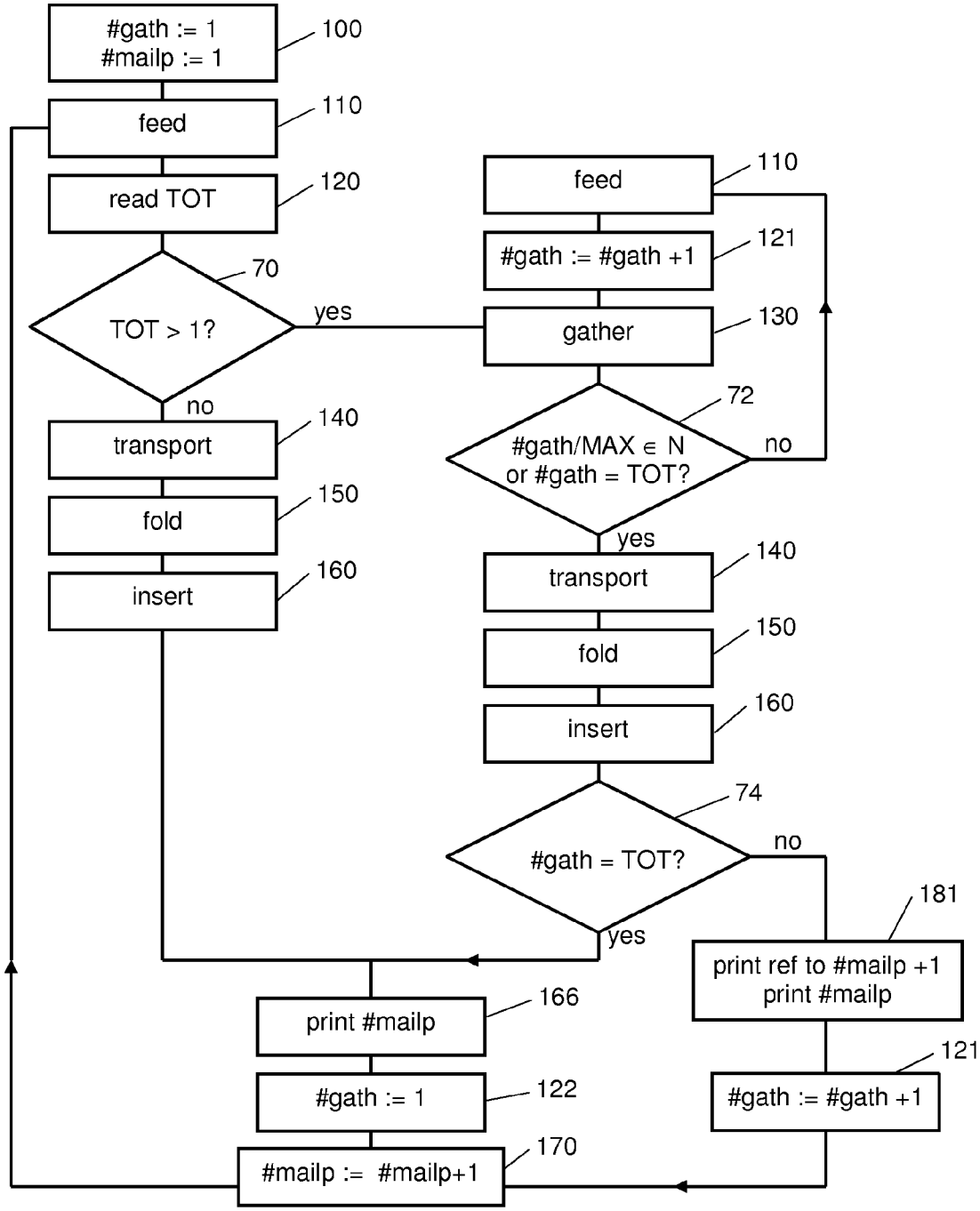
FIG. 2 is a flow chart of an example of a method according to the invention.

The method and operation of the system are further elucidated with reference to FIGS. 1 and 2. In FIG. 2 mutually identical steps are designated by the same reference numbers. The apparatus shown in FIG. 1 is prepared for a job process by loading the feeding station 2 with postal items to be mailed, for instance account statements. In the stack of postal items loaded into the feeding station, varying numbers of successive account statement sheets constitute mail sets each to be sent to one addressee, in this example as a single or multi-sheet account statement.

At the start of a job, a value one is assigned to gathering counter #gath and to mail piece counter variable #mailp (step 100). In a first cycle, a first postal item is fed to the gathering station 3 (step 110) and scanned by the scanner 9 which scans markings from the first postal item and sends a signal to the control logic 10. From the signal received from the scanner 9, the control logic 10 determines the number of postal sheets in the mail set TOT (step 120). In step 70, the control logic 10 determines whether the number TOT is larger than one. If the number is not larger than one, the postal item is transported to the folding station 4 (step 140), folded (step 150), transported to the inserting station 6 and inserted into an envelope (step 160). Finally, the current value of the mail piece counter #mailp is printed on the envelope (step 166) and the value of the mail piece counter #mailp is incremented by one (step 170). The step 122 of resetting the gathering counter value back to one is in this case superfluous, but will be needed in the present example if more than one sheet has been gathered as will be discussed below.

If, in step 70, the control logic 10 determines that the number of sheets TOT in the mail set is larger than one, the control logic 10 generates and outputs a gather signal to the gathering station 3. In response, the gathering station 3 receives the first sheet for gathering (step 130). At step 72, the control logic 10 determines whether the gathering counter #gath is a whole multiple of or equal to the maximum number of sheets MAX or equal to the number TOT of sheets of the mail set. If the value of the gathering counter #gath does not meet any of these criteria, a next sheet is fed (step 110), the value of the gathering counter #gath is incremented by one (step 121), the sheet is gathered with the previously fed sheet (step 130) and step 72 is performed again.

The maximum number of sheets MAX may be a fixed system parameter, but may also be an adjustable value stored in the control logic 10 prior to the start of the job process and valid for the job in process only. The maximum number of sheets MAX may be set by an operator, but may also be set by a computer generating the mail sets that is connected to the system and/or be generated in response to other information such as the size of envelopes or the thickness or weight of the postal items. In step 72 the criterium whether the value of the gathering counter is equal to a whole multiple of the maximum number of sheets MAX is of relevance when the sheets being gathered are sheets of a second or further mail piece of a mail set. The processing of sheets of a mail set into multiple mail pieces is described below.

Thus, the gathering station 3 continues to gather sheets until, in step 72, the control logic 10 determines that the value of the gathering counter #gath is equal to or a whole multiple of the maximum number of sheets MAX or equal to the required number TOT of sheets of the mail set. If this condition occurs, the control logic 10 generates and outputs a transport signal to the gathering station 3, causing the gathered sheets to be transported to the folding station 4 (step 140) and the folding and inserting steps 150, 160 as mentioned above to be performed on the folded mail set.

Next, the control logic 10 determines again whether the number of sheets of the mail set is equal to the required number of sheets TOT of the mail set (step 74). If the value of the gathering counter equals the number TOT of required sheets, the steps of printing the current value of the mail piece counter #mailp on the envelope, resetting the value of the gathering counter to one and incrementing the mail piece counter value #mailp as mentioned above are carried out and the system starts a new cycle.

If it is determined in step 74, that the value of the gathering counter #gath is not equal to the required number TOT of sheets of the mail set, the control logic 10 generates and outputs instructions to the printer 7 that cause the printer to print a reference to a mail piece carrying a mail piece number equal to the current value of the mail piece counter #mailp+1 and the current value of the mail piece counter #mailp on the envelope (step 181). Before returning to a next cycle the gathering counter #gath value is incremented by one (step 121) and the mail piece counter value #mailp is incremented by one (step 170). The value of the gathering counter #gath is not reset to one, because at least one next sheet to be processed is a further sheet belonging to the mail set currently being processed. The value of the gathering counter #gath is incremented by one to take into account that the next cycle starts with feeding a first sheet without incrementing the gathering counter #gath.

During a second or further cycle in which sheets of the same mail set are fed, the step 120 of reading a value of the total number TOT of sheets of the currently processed mail set will not result in a new value for the variable the total number TOT of sheets of the currently processed mail set, because either the next sheet contains no indication for the total number TOT of sheets of the currently processed mail set, so the current value is retained or the sheet carries indicia representing the current value of the total number TOT of sheets of the currently processed mail set.

During preparation of a second or further mail piece containing sheets of a mail set, the value of the gathering counter #gath is larger than the value MAX indicating the maximum number of sheets that can be included in a mail piece. To be able to check at step 72 whether the maximum number of sheets of a mail piece is not exceeded, it is checked at step 72 whether the current value of the gathering counter #gath divided by the maximum number of sheets MAX is an integer value.

As is illustrated by the present example, it is made possible in a simple manner to process mail sets containing varying numbers of postal items in a flexible, automated manner, even if some of the mail sets contain more postal items than can be inserted in one envelope. The postal items are then automatically distributed over two or more mail pieces and indications referring to mail pieces containing other postal items of a mail set are automatically printed so that it is automatically indicated to the person receiving the mail set which mail pieces belong to each other and contain postal items belonging to the same mail set.

Figure 3:
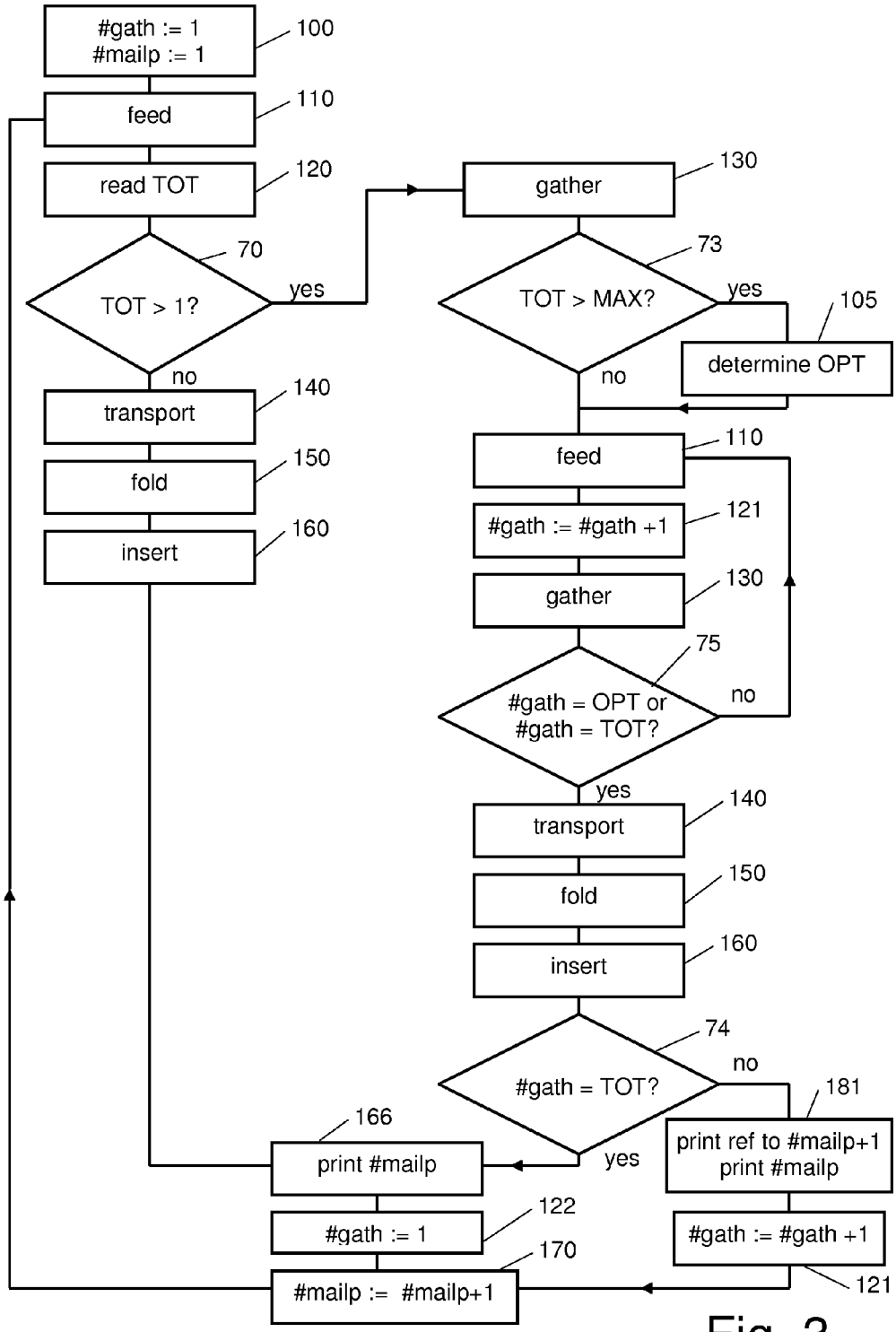
FIG. 3 is a flow chart of another example of a method according to the invention.

In FIG. 3 a flow chart of another example of a method according to the invention that can also be performed by the system of FIG. 1. As in FIG. 2, mutually identical steps are designated by mutually identical reference numerals. Moreover, steps that are, substantially, identical to steps of the method represented by FIG. 2 are designated by the same reference numerals as in FIG. 2.

In a method according to this example, the start of a job with step 100 and the start of a first cycle with steps 110, 120 and 70 is the same as in the example according to FIG. 2. Furthermore, if it is found in step 70 that the number of sheets of the mail set is one, steps 140, 150, 160, 166, 122 and 170 are also the same as in the example represented by FIG. 2.

If it is determined in step 70 that the number of sheets of the mail set is larger than one, a gathering step 130 is performed so that the sheet is received in the gathering station to be gathered with next sheets that are fed.

Next, it is determined in step 73 whether the total number of sheets is larger than the maximum number. If the answer is yes, a routine 105 for determining the optimum number of sheets for the current mail piece is started. In this routine, the distribution of sheets of a mail set to be sent to a single addressee over several mail pieces may be determined in various manners, depending on the requirements and postal rates. For instance, if a lower number of sheets than the allowed maximum number MAX allows the franking value to be lower than when the maximum number MAX of sheets is inserted, it can be attempted to keep the number of sheets for all or at least some of the mail pieces at or below the threshold value above which a higher postage value is required. It is also possible to distribute the sheets of a mail set evenly over the required number of mail pieces. Furthermore, the routine may provide for the determination of first and further values for the cumulative number of sheets OPT of a mail set for the first and further mail pieces of a mail set, the respective values being attributed to the variable OPT successively each time the determine OPT routine 105 is activated for the respective successive mail pieces.

Next, the steps 110, 121 and 130 of feeding, incrementing the gathering counter #gath and gathering sheets is the same as in the method represented by FIG. 2.

Then, in step 75, the control logic 10 determines whether the gathering counter #gath is equal to the selected (optionally cumulative) number OPT of sheets for the present mail piece or equal to the number TOT of sheets of the mail set. If the value of the gathering counter #gath does not meet any of these criteria, a next sheet is fed (step 110), the value of the gathering counter #gath is incremented by one (step 121), the sheet is gathered with the previously fed sheet (step 130) and step 72 is performed again.

Thus, the gathering station 3 continues to gather sheets until, in step 75, the control logic 10 determines that the value of the gathering counter #gath is equal to the selected (optionally cumulative) number OPT of sheets for the present mail piece or equal to the number TOT of sheets of the mail set or equal to the required number TOT of sheets of the mail set. If this condition occurs, the control logic 10 generates and outputs a transport signal to the gathering station 3, causing the gathered sheets to be transported to the folding station 4 (step 140) and the folding and inserting steps 150, 160 as mentioned above to be performed on the folded mail set.

Finally, for the present cycle, the steps of determining whether the number of sheets of the mail set is equal to the required number of sheets TOT of the mail set (step 74), the generation and outputting of instructions to the printer 7 (step 166 or 181), the resetting or incrementing of the gathering counter #gath (step 122 or, respectively, 121 and the incrementing of the mail piece counter value #mailp (step 170) are the same as in the example represented by FIG. 2.

While the invention has been illustrated and described in detail in the drawings and foregoing description, such illustration and description are to be considered illustrative or exemplary and not restrictive; the invention is not limited to the disclosed embodiments. As explained above, the different method steps may be interchanged in order to construct an embodiment of a system according to the invention more suitable for a certain type of job process. For instance, in the examples discussed above, the total number of postal items in each mail set is determined by reading information from a first page of each mail set. However, whether one or more mail pieces are required for sending a mail set may also be determined without receiving information on the number of sheets of a mail set by each time only checking whether the gathering counter #gath has reached a predetermined maximum MAX and preparing a next associated mail piece each time in response to the maximum number of sheets of the mail piece being exceeded and continuing to do so until a last sheet of the current mail set or a next sheet of the next mail set has been identified.

If information whether a further mail piece is necessary to send a mail set is not obtained until after a mail piece has been completed, for instance by identifying whether or not a next postal item that has been fed is part of the same mail set or a first postal item of a next mail set, the information on a mail piece referring to the other mail piece containing postal items of a mail set is preferably printed each time on the further mail piece containing postal items of a mail set and refers back to the mail piece containing postal items of that mail set, which has preceded that further mail piece.

When determining the maximum total number of postal items from one source, such as one or more feeders, fixed or variable numbers of enclosures or supplements to be added from other sources, if any, may be taken into account. The maximum number may for instance be based on maximum weight or thickness of the contents of a mail piece. Furthermore, instead of a maximum number, the maximum of postal items to be included in a mail piece as such may also be another type of variable, such as a maximum weight, a maximum volume or a maximum overall thickness of the postal items.

If the total number of postal items in a mail set is determined at the start of a job of preparing a series of mail pieces, the control logic can be arranged to generate a mark signal not only indicating that a mark is to be printed, but also the total number of mail pieces containing postal items of the same mail set, e.g. "⅓", "⅔", and "⅓" if three mail pieces contain postal items of the same mail set. Moreover, it is preferred that in the event of the postal items of a mail set being distributed over two or more mail pieces, references to the other mail pieces are printed on all mail pieces containing postal items of that set.

The indications referring to other mail pieces containing postal items of the same mail set and indications identifying mail pieces, such as mail piece numbers, may be printed on the envelopes, but may also be printed on postal items, preferably in such a manner that the indications appear behind the window of a window envelope of the respective mail piece.

Other variations to the disclosed embodiments can be understood and effected by those skilled in the art in practicing the claimed invention, from a study of the drawings, the disclosure, and the appended claims.

The invention claimed is:

1. A method for preparing mail pieces comprising:

providing an apparatus for preparing items to be mailed comprising:

at least one feeding station for feeding postal items of a mail set one by one;

a gathering station;

a printer for printing on postal items fed from the feeding station or on envelopes;

an inserting station for inserting postal items into envelopes;

the method comprising, for each mail set:

feeding one or more postal items from the at least one feeding station;

if more than one postal item is fed to the gathering station, gathering the postal items in the gathering station;

if all postal items of the mail set have been gathered or if a predetermined maximum of postal items has been gathered, transporting the gathered postal items to the inserting station;

at the inserting station, inserting the gathered postal items into an envelope;

determining whether the mail set includes or is to include more postal items than the predetermined maximum of postal items of a mail piece; and if the mail set includes or is to include more postal items than the predetermined maximum of postal items of a mail piece, inserting at least one remaining postal item of the mail set into a next envelope of a next mail piece, and printing an association marking on at least a postal item or the envelope of the mail piece or on a postal item or the envelope of the next mail piece, the association marking indicating that the mail piece or next mail piece carrying the association marking is associated to said next mail piece or, respectively, said mail piece.

2. A method according to claim 1, wherein, if the mail set includes or is to include more postal items than the predetermined maximum of postal items of a mail piece, printing a first association marking on a postal item or the envelope of the mail piece, the first association marking indicating that it is associated to a further mail piece carrying a further association marking, and printing the further association marking on a postal item or the envelope of the next mail piece, the further association marking indicating that it is associated to the mail piece carrying the first association marking.

3. A method according to claim 1, wherein the predetermined maximum of postal items is adjusted prior to preparation of a batch of mail pieces.

4. A method according to claim 1, further comprising, for each mail set:

determining an address to be printed on the envelope;

printing the determined address on the envelope;

if the mail set includes or is to include more postal items than the predetermined maximum of postal items of a mail piece, reprinting the address on the next envelope; and wherein the association markings and the addresses are printed by the same printer.

5. A method according to claim 1, further comprising, for each mail set:

determining the total number of postal items in a mail set prior to feeding of the postal items to the gathering station.

6. A method according to claim 1, further comprising, for each mail set:

if the mail set includes or is to include more postal items than the predetermined maximum of postal items of a mail piece, determining optimum numbers of postal items for a plurality of mail pieces to contain the postal items of the mail set; and for each mail piece, if the number of gathered postal items in the gathering station is equal to the determined optimum number of postal items for that mail piece, transporting the gathered postal items from the gathering station (3) towards the inserting station.

7. An apparatus for preparing items to be mailed, comprising:

at least one feeding station for feeding postal items of a mail set one by one;

a gathering station;

a control logic;

a sensor placed downstream of the at least one feeding station and upstream of the gathering station for detecting postal items of a mail set;

a printer for printing on postal items fed from the feeding station or on envelopes; and an inserting station for inserting postal items into envelopes;

wherein the sensor is connected to the control logic and arranged for scanning markings from documents in the feeding path and generating signals in accordance with the scanned markings;

wherein the control logic is arranged for:

generating a gather signal if a mail set comprises more than one postal item;

generating a transport signal if a mail set is completely fed to the gathering station or if a predetermined maximum of postal items is fed to the gathering station; and generating a mark signal if a mail set is to include more postal items than a predetermined maximum;

wherein the gathering station is arranged for:

gathering postal items arriving from the at least one feeding station in response to the gather signal; and transporting the gathered postal items towards the inserting station in response to the transport signal; and wherein the control logic is arranged for, in response to the mark signal, causing the printer to print an association marking on at least a postal item or an envelope of a mail piece or on a postal item or an envelope of a next mail piece, the association marking indicating that the mail piece or next mail piece carrying the association marking is associated to said next mail piece or, respectively, said mail piece.

8. An apparatus according to claim 7, wherein the control logic is further arranged for, in response to the mark signal, causing the printer to print a first association marking on a postal item or the envelope of the mail piece, the first association marking indicating that the mail piece is associated to a next mail piece carrying a next association marking, and printing the next association marking on a postal item or an envelope of the next mail piece, the next association marking indicating that the next postal item is associated to the mail piece carrying the first association marking.

9. An apparatus according to claim 7, wherein the predetermined maximum of postal items is programmable in the control logic.

10. An apparatus according to claim 7, wherein the control logic is arranged for causing the printer to print an address on the envelope; and reprinting the address on the envelope of the next mail piece in response to the mark signal.

11. An apparatus according to claim 7, wherein the control logic further is arranged for generating a mark signal indicating the number of mail pieces to be marked if the total number of postal items in the mail set detected by the sensor is determined.

12. An apparatus according to claim 7, wherein the control logic is further arranged for:

if the mail set includes or is to include more postal items than the predetermined maximum of postal items of a mail piece, determining optimum numbers of postal items for a plurality of mail pieces to contain the postal items of the mail set; and for each mail piece, if the number of gathered postal items in the gathering station is equal to the determined optimum number of postal items for that mail piece, transporting the gathered postal items from the gathering station towards the inserting station.

* * * * *